US011365865B1

(12) United States Patent
Zheng et al.

(10) Patent No.: US 11,365,865 B1
(45) Date of Patent: Jun. 21, 2022

(54) MOON LAMP

(71) Applicant: Shenzhen Bolong Technology Co. Ltd., Shenzhen (CN)

(72) Inventors: Huazhu Zheng, Shenzhen (CN); Yunyun Lu, Shenzhen (CN); Caijian Zheng, Shenzhen (CN); Wenzhen Ouyang, Shenzhen (CN)

( * ) Notice: Subject to any disclaimer, the term of this patent is extended or adjusted under 35 U.S.C. 154(b) by 0 days.

(21) Appl. No.: 17/648,081

(22) Filed: Jan. 14, 2022

(30) Foreign Application Priority Data

Dec. 15, 2021 (CN) ..... 202123156165.2

(51) Int. Cl.
*F21V 1/10* (2006.01)
*F21S 6/00* (2006.01)
*F21S 10/00* (2006.01)

(52) U.S. Cl.
CPC ..... *F21V 1/10* (2013.01); *F21S 6/002* (2013.01); *F21S 10/007* (2013.01)

(58) Field of Classification Search
CPC ..... F21V 1/10; F21S 6/002; F21S 10/007
USPC ..... 362/35, 311.01, 806, 809
See application file for complete search history.

(56) References Cited

U.S. PATENT DOCUMENTS

| | | | | |
|---|---|---|---|---|
| 5,324,224 | A * | 6/1994 | Anderson | A63H 33/26 362/184 |
| 6,550,928 | B1 * | 4/2003 | Lin | B60Q 1/2611 362/35 |
| 6,869,208 | B2 * | 3/2005 | Vogel | F21S 10/007 362/431 |
| 8,827,496 | B2 | 9/2014 | Vanderschuit | |
| 9,022,593 | B2 | 5/2015 | Yang | |
| 9,551,472 | B2 | 1/2017 | Ding | |
| 9,587,806 | B2 | 3/2017 | Liu | |
| 9,671,082 | B2 | 6/2017 | Huang | |
| 2021/0164628 | A1 * | 6/2021 | Zheng | F21V 5/02 |

FOREIGN PATENT DOCUMENTS

| | | |
|---|---|---|
| CN | 202102702 U | 1/2012 |
| CN | 202927707 U | 5/2013 |
| CN | 203500949 U | 3/2014 |
| CN | 211344886 U | 8/2020 |

* cited by examiner

*Primary Examiner* — Laura K Tso

(57) ABSTRACT

A moon Lamp is disclosed, which includes a base, a support seat and a lampshade assembly disposed above the support seat. A drive assembly for driving the support seat to rotate is provided in the base, a first groove is defined in an upper part of the base, and a first through hole is defined in a center of the first groove. The support seat includes a rotating shaft, a mount and a support bracket. The main control board and the lamp bead are arranged inside the spherical lampshade through a rotary connection between the support seat and the drive assembly of the base, and the drive assembly drives the support seat to move so as to drive the lampshade assembly to move, so that the moon Lamp presents different lighting effects and increases its use scenes.

12 Claims, 6 Drawing Sheets

MOON LAMP

CROSS REFERENCE TO RELATED APPLICATION

This application claims priority benefit of Chinese Application No. 202123156165.2, filed on Dec. 15, 2021, and the entire contents of which are incorporated herein by reference.

TECHNICAL FIELD

The disclosure relates to a technical field of lighting fixtures, in particular to a moon Lamp.

BACKGROUND ART

A light fixture is a lighting tool in human daily life. For example, a craft table lamp that can render indoor atmospheres is very popular among people, especially a spherical light fixture.

A moon Lamp is a decorative lamp that mimics a shape of the moon and can emit light from its interior, which is widely popular with people. Currently, an existing moon Lamp in the market is fixed on a base and corresponding power supply assemblies are all provided on the base, and thus it cannot be rotated, with single lighting effect and less applicable scenes.

SUMMARY

In order to overcome deficiencies of the prior art, the disclosure provides a moon Lamp, which overcomes shortcomings of the prior art that the moon Lamp does not have a rotating function and provides a single presenting effect.

Technical schemes adopted in the disclosure to solve its technical problems is to provide a moon Lamp, which includes a base, a support seat and a lampshade assembly disposed above the support seat.

A drive assembly for driving the support seat to rotate is provided in the base, a first groove is defined in an upper part of the base, and a first through hole is defined in a center of the first groove.

The support seat includes a rotating shaft, a mount and a support bracket. The rotating shaft is connected to a lower end of the mount, the rotating shaft is sleeved inside the first through hole and connected with a transmission shaft of the drive assembly, and the mount is arranged in the first groove of the support seat.

The lampshade assembly includes a spherical lampshade and a main control board provided in the spherical lampshade. The main control board is provided with lamp beads, and the lampshade assembly abuts against the support bracket.

In an embodiment, the spherical lampshade includes a light-transmitting casing and an sealed enclosure which are detachably connected with each other, and the sealed enclosure is connected at an opening below the light-transmitting casing.

In an embodiment, the spherical lampshade further includes a snap ring, which is snapped at the opening of the light-transmitting casing and is provided with a first convex step at an interval. An upper part of the sealed enclosure is provided with a limiting wall, the limiting wall is defined with a limiting concave step which is matched with the first convex step. The sealed enclosure is connected to the light-transmitting casing through matching of the limiting concave step and the first convex step.

In an embodiment, the moon Lamp further includes a speaker electrically connected with the main control board. The speaker is arranged inside the spherical lampshade, the main control board is annular, and a center of the main control board is defined with a second through hole. A side of the sealed enclosure proximate to the main control board is provided with an annular groove, the speaker passes through the second through hole and a lower end of the speaker abuts against the annular groove, and the sealed enclosure is provided with a sound hole at a position faced with the speaker.

In an embodiment, the moon Lamp further includes a first power supply assembly connected with the main control board. The first power supply assembly is arranged above the main control board. A lower end of the sealed enclosure is provided with a first charging port, a touch switch, a first infrared receiving hole and a first control switch which are electrically connected with the main control board respectively.

In an embodiment, an outer surface of the spherical lampshade of the moon Lamp is in a shape of an uneven lunar surface and an inner surface thereof is smooth.

In an embodiment, the support bracket includes an annular top and an arc-shaped connecting block. Both ends of the arc-shaped connecting block are respectively connected with the mount and the annular top, and an outer diameter of the annular top is larger than an outer diameter of the base. A plurality of the arc-shaped connecting blocks are uniformly distributed, and a gap is provided between two adjacent arc-shaped connecting blocks.

In an embodiment, the drive assembly includes a drive motor and a motor control mainboard. A second power supply assembly for supplying power to the drive motor is also provided in the base, and the second power supply assembly is electrically connected with the motor control mainboard.

In an embodiment, the second power supply assembly is a second battery, and the base includes a pedestal and a baseplate that form a second accommodating cavity. An inner side of the pedestal extends downward and is provided with a clamping position for fixing the second battery, and a clamping plate for abutting against the second battery is provided at a corresponding position of the baseplate.

In an embodiment, the pedestal is stepped and an outer diameter of the pedestal gradually decreases from bottom to top. The pedestal is sequentially provided with a second infrared receiving hole, a second charging port and a second control switch which are respectively electrically connected with the motor control mainboard.

The disclosure has beneficial effects that the main control board and the lamp bead are arranged inside the spherical lampshade through a rotary connection between the support seat and the drive assembly of the base, and the drive assembly drives the support seat to move so as to drive the lampshade assembly to move, so that the moon Lamp presents different lighting effects and increases its use scenes.

BRIEF DESCRIPTION OF THE DRAWINGS

The disclosure will be further explained below with reference to drawings and examples, in which.

Figure 1:
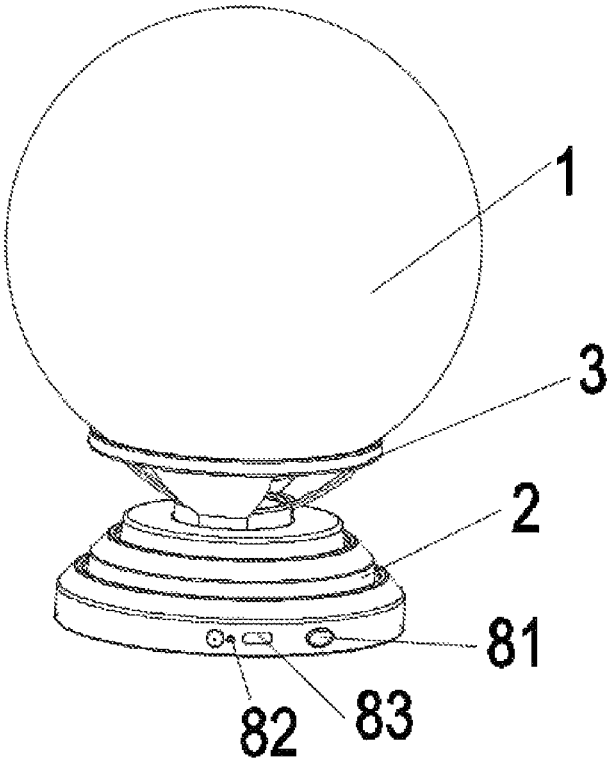
FIG. 1 is an overall schematic diagram of a moon Lamp according to the disclosure.
Figure 2:
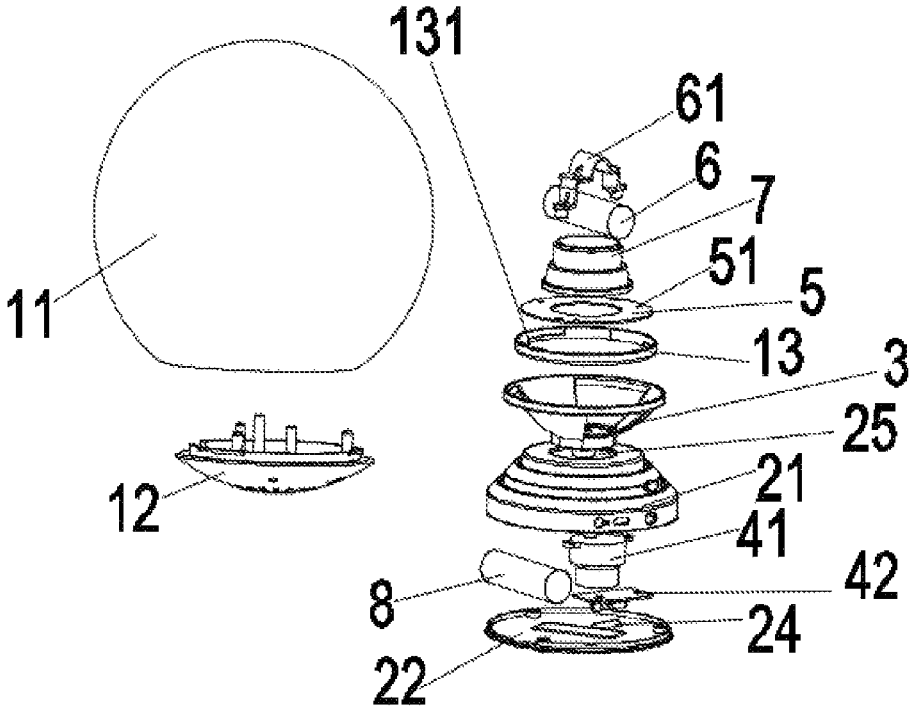
FIG. 2 is an exploded schematic diagram of a moon Lamp according to the disclosure.

1. Spherical Lampshade; 11. Light-transmitting Casing; 12. Sealed Enclosure; 121. Limiting Wall; 122. Limiting Groove; 123. First Charging Port; 124. Annular Groove; 125. Sound Hole; 126. First Control Switch; 127. Touch Switch; 128. First Infrared Receiving Hole; 13. Snap Ring; 131. First Convex Step; 2. Base; 21. Pedestal; 22. Baseplate; 23. Clamping Position; 24. Clamping Plate; 25. First Groove; 3. Support Seat; 31. Rotating Shaft; 32. Mount; 33. Support Bracket; 331. Annular Top; 332. Arc-shaped Connecting Block; 4. Drive Assembly; 41. Drive Motor; 42. Motor Control Mainboard; 5. Main Control Board; 51. Lamp Bead; 6. First Battery; 61. Fixing Piece; 7. Speaker; 8. Second Battery; 81. Second Control Switch; 82. Second Infrared Receiving Hole; 83. Second Charging Port.

DETAILED DESCRIPTION

Now, in order to make technical problems solved by this disclosure, technical solutions and beneficial effects more clear, the disclosure will be further explained in detail in connection with the drawings and embodiments. It should be understood that the specific embodiments described herein are only intended to explain the disclosure, not to limit the disclosure.

With reference to FIGS. 1-6, a moon Lamp is provided, which includes a base 2, a support seat 3 and a lampshade assembly disposed above the support seat 3. A drive assembly 4 is provided in the base 2, the support seat 3 is connected with the drive assembly 4, and a lampshade assembly is provided on the support seat 3 and moves with movement of the support seat 3, so that a rotatable effect of the moon Lamp can be realized, and its use scenes can be increased.

Specifically, the lampshade assembly includes a spherical lampshade 1 and a main control board 5 provided inside the spherical lampshade 1. An outer surface of the spherical lampshade 1 is in a shape of an uneven lunar surface and an inner surface thereof is smooth, similar to the moon in shape. The spherical lampshade 1 includes a light-transmitting casing 11 and an sealed enclosure 12 which form a first accommodating cavity, an opening is defined below the light-transmitting casing 11, and the sealed enclosure 12 is detachably connected to the opening of the light-transmitting casing 11.

In this embodiment, the spherical lampshade 1 further includes a snap ring 13, which is snapped at the opening of the light-transmitting casing 11. The snap ring 13 is provided with a first convex step 131 at an interval. An outer edge of the sealed enclosure 12 is matched with the spherical lampshade 1. An upper part of the sealed enclosure 12 is provided with a limiting wall 121 proximate to the outer edge, and a limiting groove 122 is correspondingly provided on the limiting wall 121, so that the sealed enclosure 12 is sleeved on the light-transmitting casing 11, and then the first convex step 131 and the limiting groove 122 can be rotated to cooperate with each other to realize a connection between the sealed enclosure 12 and the light-transmitting casing 11. The use of snap ring 13 for connection facilitates disassembling of the sealed enclosure 12 and light-transmitting casing 11 without affecting appearance of the moon Lamp. In other embodiments, the light-transmitting casing 11 and the sealed enclosure 12 can be snap-fit to each other, or detachably connected with each other by a screw.

In this embodiment, the main control board 5 is arranged in the spherical lampshade 1, and the main control board 5 is provided with lamp beads 51, so that different colors of lights can be adjusted according to the different lamp beads 51, so as to realize different moon Lamp effects. The main control board 5 is arranged in the first accommodating cavity, so that a volume of the base 2 can be effectively reduced and at the same time, controlling of the lamp beads 51 can be facilitated, and the light is emitted from inside of the spherical lampshade 1, with an excellent presenting effect. In an embodiment, a first power supply assembly is correspondingly provided in the first accommodating cavity, and the first power supply assembly is electrically connected with the main control board 5 and configured for supply power to the main control board 5. The first power supply assembly is a rechargeable first battery 6, and the first power supply assembly is preferably arranged above the main control board 5.

Further, a lower end of the sealed enclosure 12 is defined with a first charging port 123, which is electrically connected with the main control board 5. The first charging port 123 can be configured to directly supply power to the main control board 5 or to charge the first battery 6.

The lamp beads 51 can be provided in one group or multiple groups as required, and a plurality of lamp beads can be included in each group, which are evenly distributed on the main control board 5. Specifically, it can be a group of RGB patch lamp beads, which can realize adjustment and transformation of different colors. Alternatively, two groups of lamp beads are used, one group consisting of warm white patch lamp beads and the other consisting of RGB patch lamp beads.

A lower end of the sealed enclosure 12 is provided with a first control switch 126 for controlling the light in the spherical lampshade 1, and the first control switch 126 is electrically connected with the main control board 5. Furthermore, the lower end of the sealed enclosure 12 is also provided with a touch switch 127 for adjusting light colors, which is electrically connected with the main control board 5. When the lunar sphere is turned on, different colors of the moon Lamp can be changed by clicking the touch switch 127.

Meanwhile, the main control board 5 is provided with an infrared receiving module, and the lower end of the sealed enclosure 12 is defined with a first infrared receiving hole 128, so that the light of the moon Lamp can be adjusted by a remote control device.

The moon Lamp of this disclosure further includes a speaker 7 provided in the spherical lampshade 1, and a communication module and an audio module are provided on the main control board 5. The communication module includes a Bluetooth module and a Wi-Fi module, and the speaker 7 is electrically connected with the main control board 5 for playing an audio. The audio can be from an intelligent terminal connected via Bluetooth or Wi-Fi, or can be audio content burned in an audio assembly.

In this embodiment, in order to make this structure more compact and guarantee a product volume, the main control board 5 is annular, a center of the main control board 5 is defined with a second through hole, and the speaker 7 passes through the second through hole. Further, A side of the sealed enclosure 12 proximate to the main control board 5 is provided with an annular groove 124, a lower end of the speaker 7 abuts against the annular groove 124, and the sealed enclosure 12 is provided with a sound hole 125 at a position faced with the speaker 7. Provision of the speaker 7 makes the moon Lamp have a function of playing the audio, which can meet more needs of users. The speaker 7 and the annular main control board 5 are arranged in such a way that a structure of the first accommodating cavity is compact and the electrical connection between the main control board 5 and the first control switch 126 on a housing is facilitated. The sound hole 125 is arranged at a lower part of the sealed enclosure 12, which will not affect the appearance of the moon Lamp, and the sound hole 125 can simultaneously function to radiate heat.

The support seat 3 includes a rotating shaft 31, a mount 32 and a support bracket 33. The rotating shaft 31 is connected to a lower end of the mount 32, the support bracket 33 is connected to an upper end of the mount 32, the support seat 3 is used for supporting the spherical lampshade 1, a drive assembly 4 for driving the support seat 3 to rotate is provided in the base 2, and the spherical lampshade 1 can rotate together with the support seat 3 under an action of the drive assembly 4.

Specifically, an upper part of the base 2 is defined with a first groove 25, and a first through hole is defined in a center of the first groove 25. The rotating shaft 31 of the support seat 3 is sleeved inside the first through hole and connected with a transmission shaft of the drive assembly 4, and the mount 32 is arranged in the first groove 25 of the support seat 3.

In an embodiment, the support bracket 33 includes an annular top 331 and an arc-shaped connecting block 332. Both ends of the arc-shaped connecting block 332 are respectively connected with the mount 32 and the annular top 331, the spherical lampshade 1 abuts against the annular top 331, and an outer diameter of the annular top 331 is larger than an outer diameter of the base 2, resulting in a bracket shape with a wider upper part and a narrower lower part. A plurality of the arc-shaped connecting blocks 332 are uniformly distributed, and a gap is provided between two adjacent arc-shaped connecting blocks 332 for heat dissipation and aesthetics appearance.

The drive assembly 4 is arranged in the base 2 to ensure a compact structure and convenient assembly. Specifically, the drive assembly 4 includes a drive motor 41 and a motor control mainboard 42, and an output shaft of the drive motor 41 is connected with the rotating shaft 31. Further, a second power supply assembly for supplying power to the drive motor 41 is also provided in the base 2, and the second power supply assembly is electrically connected with the motor control mainboard 42. The second power supply module is configured to control the drive module 4 individually, which can be separated from controlling of the spherical lampshade 1, thus preventing the wiring from crossing and reducing service life.

Figure 3:
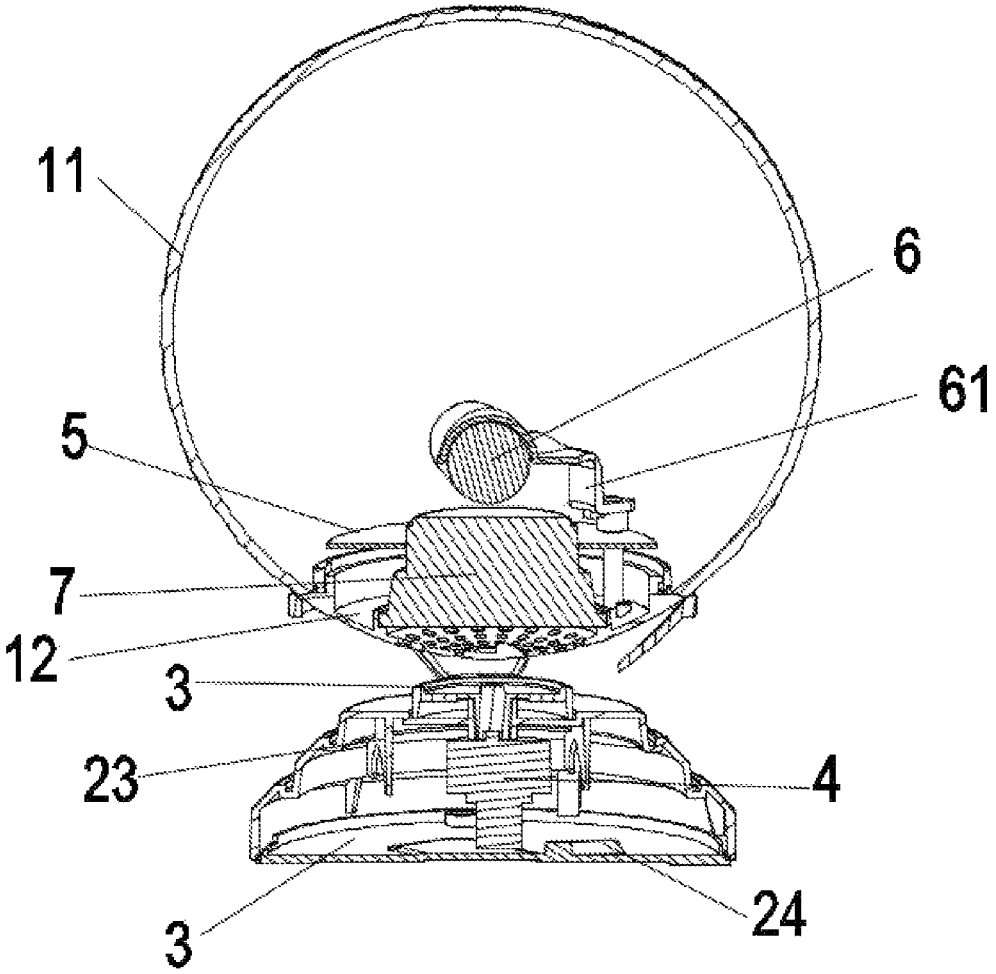
FIG. 3 is a semi-sectional schematic diagram of a moon Lamp according to the disclosure.
Figure 4:
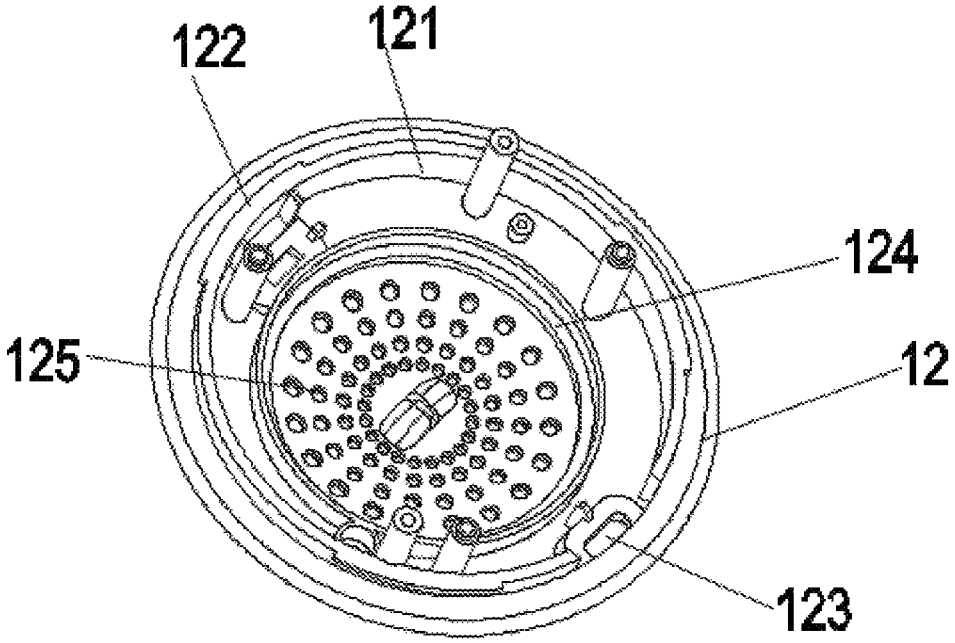
FIG. 4 is a schematic diagram of an sealed enclosure according to the disclosure.
Figure 5:
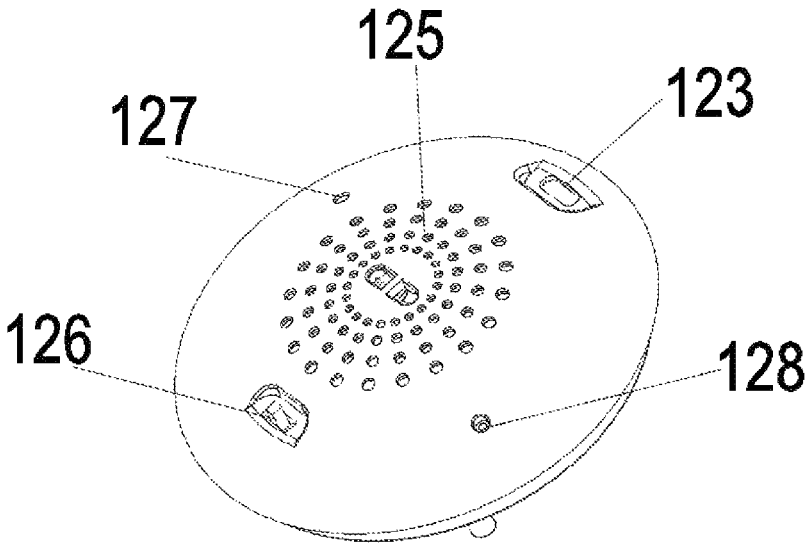
FIG. 5 is a rear schematic diagram of an sealed enclosure according to the disclosure.
Figure 6:
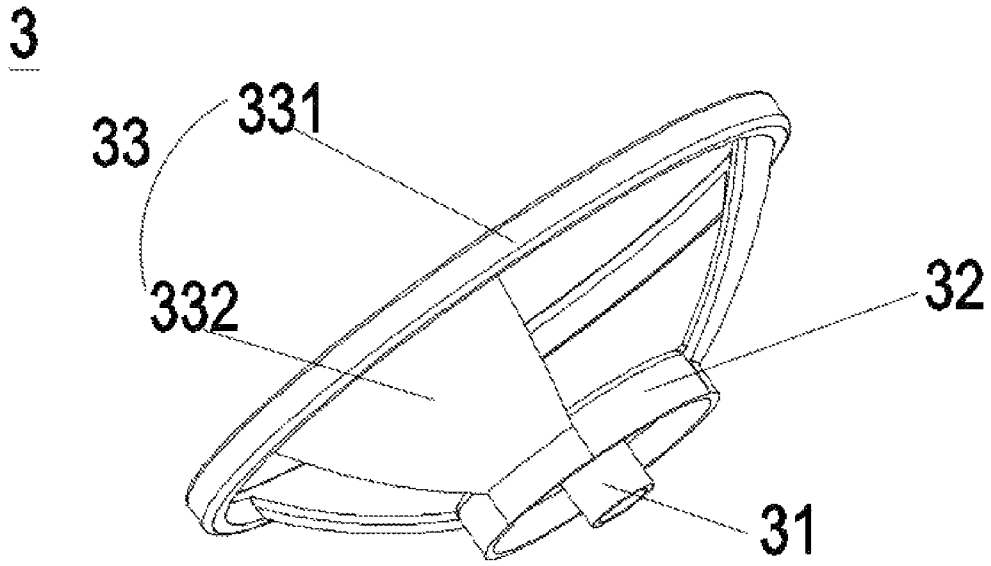
FIG. 6 is a schematic diagram of a support bracket according to the disclosure.

In this embodiment, the second power supply assembly is the second battery 8, and the second battery 8 is omitted in FIG. 3. The second battery 8 is configured to supply power to the drive assembly 4. Further, the base 2 can be further provided with a second charging port 83 which is electrically connected with the motor control mainboard 42, and with this second charging port 83, the second battery 8 can be charged or the base 2 can be directly powered. In other embodiments, the second battery 8 can be excluded, and the power supply can be directly accessed through the second charging port 83 for powering.

The base 2 includes a pedestal 21 and a baseplate 22, which form a second accommodating cavity. The baseplate 22 is connected to the pedestal 21 by a screw. An inner side of the pedestal 21 extends downward and is provided with a clamping position 23 for fixing the second battery 8, and a clamping plate 24 for abutting against the second battery 8 is provided at a corresponding position of the baseplate 22, and the second battery 8 is fixed using the clamping position 23 and the clamping plate 24 to ensure structural stability.

In this embodiment, the pedestal 21 is stepped and an outer diameter of the pedestal gradually decreases from bottom to top, and the second battery 8 and the drive assembly 4 are fixed in the second accommodating cavity, which is compact and beautiful in structure.

The pedestal 21 is also provided with a second control switch 81 and a second infrared receiving hole 82 which are respectively connected with the motor control mainboard 42. The second control switch 81 is configured to control turning on or off of the drive assembly 4, and the motor control mainboard 42 is provided with an infrared receiving module, and the drive assembly in the base 2 can be controlled by a remote control device.

By arranging the lampshade assembly on the support seat 3, the drive assembly 4 in the base 2 can drive the lampshade assembly to move and the light can be adjusted in the lampshade assembly at the same time, and these two aspects can be separately controlled, thus increasing atmosphere effect of the moon Lamp.

The above presents one or more embodiments provided in combination with specific content, and it is not deemed that specific implementations of the disclosure is only limited to these descriptions. Any approximation or similarity with the method and structure of this disclosure, or some technical deduction or replacement on the premise of the concept of this disclosure, should fall within a protection scope of this disclosure.

The invention claimed is:

1. A moon Lamp, comprising a base, a support seat and a lampshade assembly disposed above the support seat, wherein, a drive assembly for driving the support seat to rotate is provided in the base, a first groove is defined in an upper part of the base, and a first through hole is defined in a center of the first groove;

the support seat comprises a rotating shaft, a mount and a support bracket, the rotating shaft being connected to a lower end of the mount, the rotating shaft being sleeved inside the first through hole and connected with a transmission shaft of the drive assembly, and the mount being arranged in the first groove of the support seat; and the lampshade assembly comprises a spherical lampshade and a main control board provided in the spherical lampshade, the main control board being provided with lamp beads, and the lampshade assembly abutting against the support bracket.

2. The moon Lamp according to claim 1, wherein the spherical lampshade comprises a light-transmitting casing and an sealed enclosure which are detachably connected with each other, the sealed enclosure being connected at an opening below the light-transmitting casing.

3. The moon Lamp according to claim 2, wherein the spherical lampshade further comprises a snap ring which is snapped at the opening of the light-transmitting casing and is provided with a first convex step at an interval, and an upper part of the sealed enclosure is provided with a limiting wall, the limiting wall is defined with a limiting concave step which is matched with the first convex step, and the sealed enclosure is connected to the light-transmitting casing through matching of the limiting concave step and the first convex step.

4. The moon Lamp according to claim 1, wherein the moon Lamp further comprises a speaker electrically connected with the main control board; the speaker is arranged inside the spherical lampshade, the main control board is annular, and a center of the main control board is defined with a second through hole; and a side of the sealed enclosure proximate to the main control board is provided with an annular groove, the speaker passes through the second through hole and a lower end of the speaker abuts against the annular groove, and the sealed enclosure is provided with a sound hole at a position faced with the speaker.

5. The moon Lamp according to claim 4, wherein the moon Lamp further comprises a first power supply assembly connected with the main control board; the first power supply assembly is arranged above the main control board; and a lower end of the sealed enclosure is provided with a first charging port, a touch switch, a first infrared receiving hole and a first control switch which are electrically connected with the main control board respectively.

6. The moon Lamp according to claim 5, wherein an outer surface of the spherical lampshade of the moon Lamp is in a shape of an uneven lunar surface and an inner surface thereof is smooth.

7. The moon Lamp according to claim 1, wherein the support bracket comprises an annular top and an arc-shaped connecting block; both ends of the arc-shaped connecting block are respectively connected with the mount and the annular top, and an outer diameter of the annular top is larger than an outer diameter of the base; and a plurality of the arc-shaped connecting blocks are uniformly distributed, and a gap is provided between two adjacent arc-shaped connecting blocks.

8. The moon Lamp according to claim 1, wherein the drive assembly includes a drive motor and a motor control mainboard; a second power supply assembly for supplying power to the drive motor is also provided in the base, and the second power supply assembly is electrically connected with the motor control mainboard.

9. The moon Lamp according to claim 8, wherein the second power supply assembly is a second battery, and the base comprises a pedestal and a baseplate that form a second accommodating cavity; an inner side of the pedestal extends downward and is provided with a clamping position for fixing the second battery, and a clamping plate for abutting against the second battery is provided at a corresponding position of the baseplate.

10. The moon Lamp according to claim 9, wherein the pedestal is stepped and an outer diameter of the pedestal gradually decreases from bottom to top; the pedestal is sequentially provided with a second infrared receiving hole, a second charging port and a second control switch which are respectively electrically connected with the motor control mainboard.

11. The moon Lamp according to claim 2, wherein the moon Lamp further comprises a speaker electrically connected with the main control board; the speaker is arranged inside the spherical lampshade, the main control board is annular, and a center of the main control board is defined with a second through hole; and a side of the sealed enclosure proximate to the main control board is provided with an annular groove, the speaker passes through the second through hole and a lower end of the speaker abuts against the annular groove, and the sealed enclosure is provided with a sound hole at a position faced with the speaker.

12. The moon Lamp according to claim 3, wherein the moon Lamp further comprises a speaker electrically connected with the main control board; the speaker is arranged inside the spherical lampshade, the main control board is annular, and a center of the main control board is defined with a second through hole; and a side of the sealed enclosure proximate to the main control board is provided with an annular groove, the speaker passes through the second through hole and a lower end of the speaker abuts against the annular groove, and the sealed enclosure is provided with a sound hole at a position faced with the speaker.

* * * * *